US009341023B2

(12) United States Patent
Defretin et al.

(10) Patent No.: US 9,341,023 B2
(45) Date of Patent: May 17, 2016

(54) SYSTEM AND METHOD FOR MOVING A FIRST FLUID USING A SECOND FLUID

(71) Applicant: Schlumberger Technology Corporation, Sugar Land, TX (US)

(72) Inventors: Harmel Defretin, Sugar Land, TX (US); Anthony Frank Veneruso, Sugar Land, TX (US); Glenn Gardner, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 152 days.

(21) Appl. No.: 14/015,671

(22) Filed: Aug. 30, 2013

(65) Prior Publication Data

US 2014/0000963 A1 Jan. 2, 2014

Related U.S. Application Data

(62) Division of application No. 12/701,863, filed on Feb. 8, 2010, now abandoned.

(51) Int. Cl.

| | |
|---|---|
| ***E21B 36/00*** | (2006.01) |
| ***E21B 7/00*** | (2006.01) |
| ***E21B 21/00*** | (2006.01) |
| ***F04B 17/04*** | (2006.01) |
| ***F04F 1/06*** | (2006.01) |
| ***F04F 1/08*** | (2006.01) |
| ***F04F 99/00*** | (2009.01) |

(52) U.S. Cl.

CPC . *E21B 7/00* (2013.01); *E21B 21/00* (2013.01); *F04B 17/042* (2013.01); *F04B 17/044* (2013.01); *F04F 1/06* (2013.01); *F04F 1/08* (2013.01); *F04F 99/00* (2013.01); *Y10T 137/2931* (2015.04)

(58) Field of Classification Search

CPC ..... E21B 36/00; E21B 36/001

See application file for complete search history.

(56) References Cited

U.S. PATENT DOCUMENTS

| | | | |
|---|---|---|---|
| 4,802,534 | A | 2/1989 | Larson et al. |
| 4,808,079 | A | 2/1989 | Crowley et al. |

(Continued)

FOREIGN PATENT DOCUMENTS

| | | | |
|---|---|---|---|
| DE | 10313603 | A1 | 6/2004 |
| EP | 2354547 | A1 | 8/2011 |

(Continued)

OTHER PUBLICATIONS

"Flow behavior of ferrofluids", Nov. 17, 2008, http://web.archive.org/web/20040603005615/http://www-theory.mpip-mainz.mpg.de/~hwm/ferro.html.

(Continued)

*Primary Examiner* — Catherine Loikith

(74) *Attorney, Agent, or Firm* — Kenneth L. Kincaid

(57) ABSTRACT

A first fluid is moved using a second fluid. The first fluid may be moved using a ferrofluid attracted by an electromagnetic field. The electromagnetic field may be generated by an electromagnetic source connected to a conduit, and the first fluid may move through the conduit. In an embodiment, the first fluid may absorb heat from a heat source and transfer the heat to a heat sink. For example, the heat source may be a component of a tool located in a wellbore, and the heat sink may be the wellbore. In an embodiment, the electromagnetic source may be one or more three-phase coils.

20 Claims, 4 Drawing Sheets

(56) References Cited

U.S. PATENT DOCUMENTS

| | | | | |
|---|---|---|---|---|
| 4,967,831 | A | 11/1990 | Leland | |
| 5,005,639 | A | 4/1991 | Leland | |
| 5,599,474 | A | 2/1997 | Weiss et al. | |
| 6,241,480 | B1 | 6/2001 | Chu et al. | |
| 6,318,970 | B1 | 11/2001 | Backhouse | |
| 6,705,089 | B2 | 3/2004 | Chu et al. | |
| 7,095,143 | B2 | 8/2006 | Hsu | |
| 7,295,435 | B2 | 11/2007 | Ouyang | |
| 7,340,904 | B2 | 3/2008 | Sauciuc et al. | |
| 7,806,173 | B2 | 10/2010 | Kaul et al. | |
| 2004/0234392 | A1 | 11/2004 | Ghoshal et al. | |
| 2008/0314638 | A1* | 12/2008 | Kaul et al. | 175/17 |
| 2010/0164303 | A1* | 7/2010 | Veneruso | 310/11 |
| 2011/0192573 | A1* | 8/2011 | Defretin et al. | 165/104.19 |

FOREIGN PATENT DOCUMENTS

| | | | | |
|---|---|---|---|---|
| JP | 2001077571 | A | * | 3/2001 |
| WO | 0144667 | A1 | | 6/2001 |
| WO | 2008074428 | A1 | | 6/2008 |

OTHER PUBLICATIONS

"Heat pipe manufacturer", Nov. 17, 2008, http://www.1-act.com/.

"Heat pipe supplier", Nov. 17, 2008, http://www.enertron-inc.com/enertron-products.aspx.

"Heat Sink Guide", Nov. 17, 2008, http://www.heatsink-guide.com/content.php?content=heatpipes.shtml.

"High Temperature and High Heat Flux Thermal Management for Electronics", Nov. 17, 2008, http://www.1-act.com/high-temperature-and-high-heat-flux-thermal-management-for-electronics/.

Search Report issued in related EP application 11275022.9 on Jun. 9, 2011, 7 pages.

"Thermacore Heat pipes", Nov. 17, 2008, http://www.thermacore.com/Default.aspx.

Pamme, "Magnetism and Microfluids", 2006, pp. 24-38, http://www.hull.ac.uk/chemistry/academic_staff.php?id=np/; Lab on a Chip, 6; http://www.rsc.org/delivery/_ArticleLinking/DisplayArticleForFree.cfm?doi=b513005k&JournalCode=LC.

* cited by examiner

SYSTEM AND METHOD FOR MOVING A FIRST FLUID USING A SECOND FLUID

CROSS-REFERENCE TO RELATED APPLICATIONS

This application is a divisional of and claims priority to U.S. patent application Ser. No. 12/701,863, entitled "System and Method for Moving a First Fluid Using a Second Fluid," filed Feb. 8, 2010, which is hereby incorporated herein by reference in its entirety.

BACKGROUND OF THE INVENTION

The present invention generally relates to a system and method for moving a first fluid using a second fluid. More specifically, the present invention relates to system and method for moving a first fluid using a ferrofluid attracted by an electromagnetic field. The electromagnetic field may be generated by an electromagnetic source connected to a conduit, and the first fluid may move through the conduit. In an embodiment, the first fluid may absorb heat from a heat source and transfer the heat to a heat sink.

Integrated circuits dissipate heat which may prevent or may hinder operation. More powerful or more sophisticated integrated circuits, such as, for example, integrated circuits with a higher processing speed, typically dissipate more heat than less powerful or less sophisticated integrated circuits; accordingly, powerful or sophisticated integrated circuits are more susceptible to overheating and/or failure. For example, integrated circuits with a higher processing speed typically use an increased transistor density and a higher operating frequency relative to integrated circuits with a lower processing speed, and the increased transistor density and the higher operating frequency cause the integrated circuit to dissipate more heat.

Although mechanical pumps which propel fluid, fans which circulate air and similar mechanical means may be used to provide heat transfer, such mechanical means are susceptible to mechanical failure, especially at higher temperatures. For example, such mechanical means have moving parts which may be damaged by the higher temperatures and wear due to use. Further, heat transfer by such mechanical means is not optimal due to friction and other resistive forces against the moving parts. Moreover, such mechanical means typically increase the size of the assembly an unsuitable amount. The continuing increase in processing power of integrated circuits will only escalate the importance of effective cooling.

Effective cooling may be a problem in drilling operations performed to obtain hydrocarbons. To obtain hydrocarbons, a drill bit is driven into the ground surface to create a borehole through which the hydrocarbons are extracted. Typically, a drill string is suspended within the borehole. The drill bit is connected to a lower end of the drill string. The drill string extends from the surface to the drill bit. The drill string has a bottom hole assembly (BHA) located proximate to the drill bit.

Drilling operations typically require monitoring to determine the trajectory of the borehole. Measurements of drilling conditions, such as, for example, drift of the drill bit, inclination and azimuth, may be necessary for determination of the trajectory of the borehole, especially for directional drilling. As a further example, the measurements of drilling conditions may be information regarding the borehole and/or a formation surrounding the borehole and/or fluids within the formation and/or fluids within the borehole itself. The BHA may have tools that may generate and/or may obtain the measurements. The measurements by the tools may be used to predict downhole conditions and make decisions concerning drilling operations. Such decisions may involve well planning, well targeting, well completions, operating levels, production rates and other operations and/or conditions. In addition to obtaining measurements, the downhole tools may regulate power, receive commands from the surface, communicate data to the surface or another tool connected to the drill string, and control motors and/or other electromechanical devices associated with the drill string.

Integrated circuits and power semiconductor devices located in the downhole tools dissipate heat, and operation of these circuits located in the downhole tools may cease and/or may be hindered by the heat. As discussed previously, integrated circuits with a higher processing speed typically dissipate more heat; accordingly, integrated circuits used in advanced drilling technology are more susceptible to overheating and/or failure. Further, advanced drilling technology enables hydrocarbons to be obtained from environments which are deeper and hotter than previously attainable locations. The combination of increased heat dissipation by powerful and sophisticated downhole tools and the high temperature environments encountered by the downhole tools requires effective cooling to sustain operation of the downhole tools and their integrated circuits.

It is well known that of the three principal means of passive heat transfer, namely conduction, convection and radiation, only conduction is viable to transfer heat from downhole tools to the wellbore. A typical cooling system minimizes thermal resistance between the wellbore and the heat source, such as, for example, a semiconductor substrate, by using efficient heat conducting material, such as, for example, copper, aluminum and/or graphite. In addition, passive heat pipes may assist heat transfer. For example, the thermal conductivity of copper is 401 W/mK, and the thermal conductivity of graphite is 1,200 W/mK. A heat pipe may transport a heat flux of approximately 350 W/cm$^2$ with a thermal conductivity of approximately 5,000 W/mK over a limited temperature range which extends to 150° C. However, despite the use of such heat conducting material and passive heat pipes, geometric constraints may hinder the heat transfer, and the heat transfer requirements of powerful and sophisticated downhole tools may not be met.

A heat pipe is a closed metal tube, typically mounted vertically and partially filled with a fluid, such as water. Application of heat to the lower end of the tube evaporates the water and thereby helps to cool the heat source. The upper end of the tube may be equipped with a heat sink, and the vapor may move up the tube and condense at the heat sink. The condensed fluid flows back to the lower end of the tube and may be heated and may evaporate again. The process may continue if the lower end and the upper end of the tube have different temperatures.

A problem with heat pipes is that heat pipes operate over a limited temperature range. For example, normal atmospheric pressure enables the heat pipe to maintain a heat source temperature of approximately 100° C., the temperature at which water evaporates. In addition to the temperature range of the fluid, thermal stability and thermal conductivity restrict the choice of fluid. Distilled water may be used with additives, such as, for example, acetone, methanol, ethanol and/or toluene. However, for temperatures above 100° C., the choices of suitable fluids are limited, and an increase in internal vapor pressure results in a maximum operating temperature of 150° C.

Another problem with heat pipes is orientation sensitivity. The standard heat pipe only operates in a vertical orientation because the condensed fluid must flow back to the lower end of the tube. To address this problem, capillary action may move the fluid back to the heat source. For example, a capillary structure, such as a wick, a multilayered metal mesh, or a grooved or sintered metal annulus may be connected to the interior of the tube. However, even with a capillary structure, heat pipes may lose half of their performance at 90° C. High angle wells and horizontal wells increase retrieval of the hydrocarbons and improve recovery of the area in which the wellbore is located, and heat pipes may not effectively transfer heat in such wells because of the orientation sensitivity of the heat pipes.

Yet another problem with heat pipes is failure if overheated. If the ambient temperature of the heat pipe or the temperature of the heat source exceeds a maximum operating temperature for the heat pipe, the fluid does not condense and the heat pipe will not transfer heat.

Accordingly, effective cooling is necessary to reduce equipment failure and enable increased processing power.

DETAILED DESCRIPTION

The present disclosure generally relates to a system and method for moving a first fluid using a second fluid. More specifically, the present invention relates to system and method for moving a first fluid using a ferrofluid attracted by an electromagnetic field. The electromagnetic field may be generated by an electromagnetic source connected to a conduit, and the first fluid may move through the conduit in response to attraction of the second fluid to the electromagnetic field. In an embodiment, the first fluid may absorb heat from a heat source and transfer the heat to a heat sink. For example, the heat source may be a component of a tool located in a wellbore, and the heat sink may be the wellbore. In an embodiment, the electromagnetic source may be one or more three-phase coils.

Figure 1:
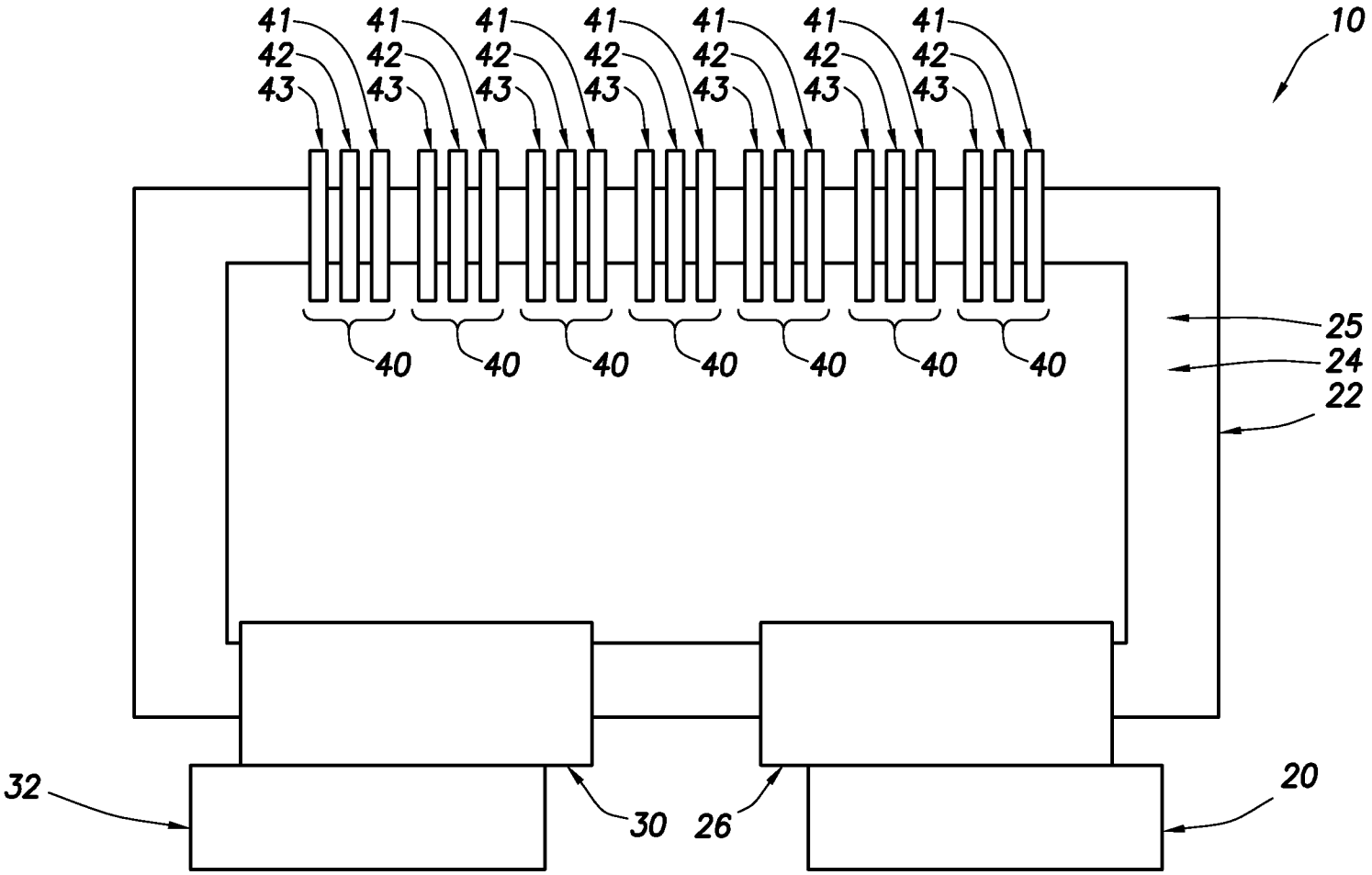
FIG. 1 illustrates a system for moving a first fluid using a second fluid in an embodiment of the present invention.

Referring now to the drawings wherein like numerals refer to like parts, FIG. 1 generally illustrates a system 10 for moving a first fluid 24 using a second fluid 25 in an embodiment of the present invention. The first fluid 24 may be in contact and/or may be mixed with the second fluid 25. The second fluid 25 may be and/or may have a ferrofluid which may be a stable colloidal suspension of magnetically energized particles, such as, for example, magnetite, hematite and/or another compound containing iron. In an embodiment, the magnetically energized particles may be nanoparticles which may have a diameter between approximately one nanometer and approximately one hundred nanometers, such as, for example, ten nanometers. In an embodiment, the first fluid 24 and/or the second fluid 25 may have a surfactant which may prevent the magnetically energized particles from adhering to each other. The present invention is not limited to a specific embodiment of the ferrofluid.

In the absence of a magnetic field, the second fluid 25 and/or the magnetically charged particles may be randomly distributed and/or may be homogeneous in the first fluid 24. If a magnetic field is applied to the first fluid 24 and/or the second fluid 25, the second fluid 25 and/or the magnetically energized particles may move according to the direction of the magnetic field. If the magnetic field is removed, the second fluid 25 and/or the magnetically energized particles may become randomly distributed and/or homogeneous in the first fluid 24 again. The present invention is not limited to a specific embodiment of the second fluid 25 or the magnetically energized particles, and the second fluid 25 and the magnetically energized particles may be any fluid and any particles which may be moved by a magnetic field.

The system 10 may have a conduit 22 which may contain the first fluid 24 and/or the second fluid 25. In an embodiment, the conduit 22 may be manufactured from a material having a high thermal conductivity, such as a metal. The material may not attract the magnetically energized particles of the second fluid 25. The system 10 may be connected to a heat source 20, such as, for example, an integrated circuit. In an embodiment, the heat source 20 may be a component of a downhole tool associated with a drill string located in a wellbore. The component may be, for example, a central processing unit ("CPU"), a digital signal processor ("DSP"), a power supply, a power switch, a power regulator, a motor driver and/or the like. The downhole tool may be, for example, a telemetry and surveying tool, a reservoir sampling and pressure tool, a formation evaluation tool, a sensor, a retrieval tool, a bottom hole assembly, a locator, a sensor protector and/or the like and/or combinations thereof. The downhole tool may be, for example, a measurement-while-drilling ("MWD") tool, a logging-while-drilling ("LWD") tool, a component of a bottom hole assembly (BHA), and/or a wireline configurable tool, such as a tool commonly conveyed by wireline cable as known to one having ordinary skill in the art. The present invention is not limited to a specific embodiment of the heat source 20, and the heat source 20 may be any heat source known to one having ordinary skill in the art. The heat source 20 is not required to be a component of a downhole tool.

A heat absorbing plate 26 may be connected to the conduit 22 to transfer heat from the heat source 20 to the first fluid 24 using thermal conduction. As discussed in more detail hereafter, the first fluid 24 may travel from the heat absorbing plate 26 through the conduit 22 to a heat spreader 30 which may be connected to the conduit 22. The heat spreader 30 may be in contact with a heat sink 32, such as, for example, the wellbore in which the heat source 20 is located. However, the heat sink 32 may be any environment, fluid or substance about, adjacent or near the conduit 22 and/or the heat spreader 30. For example, in the oilfield industry, the heat sink 32 may be the atmosphere if the component is at the Earth's surface, or may be water if the component is located in an offshore and/or subsea wellbore. The heat spreader 30 may conduct the heat from the first fluid 24 to the heat sink 32. The heat absorbing plate 26 and/or the heat spreader 32 may be manufactured from a thermally conductive material, such as a metal, for example, copper, aluminum and/or the like. The present invention is not limited to a specific embodiment of the heat sink 32, and the heat sink 32 may be any recipient of the heat transferred from the first fluid 24 known to one having ordinary skill in the art.

The conduit 22 may form a continuous loop that may enable the first fluid 24 to travel from the heat absorbing plate 26 to the heat spreader 30 and, then, back to the heat absorbing plate 26. For example, the conduit 22 may form a circle, an oval, a square, a rectangle and/or the like. In an embodiment, a first portion of the first fluid 24 may travel from the heat absorbing plate 26 to the heat spreader 30 substantially simultaneously to a second portion of the first fluid 24 traveling from the heat spreader 30 to the heat absorbing plate 26. The present invention is not limited to a specific shape of the conduit 22.

The system 10 may have an electromagnetic source. The electromagnetic source may substantially surround the conduit 22 and/or a section of the conduit 22. For example, in an embodiment, the conduit 22 and/or the section of the conduit 22 may have a perimeter, and the electromagnetic source may be adjacent to the perimeter in its entirety. The electromagnetic source may extend from one side of the conduit 22 to an opposite side of the conduit 22. For example, the electromagnetic source may extend from one side of the section of the conduit 22 to an opposite side of the section of the conduit 22. In an embodiment, the conduit 22 may have an opening which may extend through the electromagnetic source, and the conduit 22 may extend through the opening. The electromagnetic source may be fixedly and/or rigidly connected to an interior and/or an exterior of the conduit 22 such that the electromagnetic source does not move relative to the conduit 22.

In an embodiment, the electromagnetic source may be one or more three-phase coils 40, although the present invention is not limited to a specific embodiment of the electromagnetic source. The three-phase coils 40 may be wound around the conduit 22 and/or a section of the conduit 22. For example, the three-phase coils 40 may substantially surround and/or may encircle the section of the conduit 22 so that the section of the conduit 22 is located within the center or tubular shaped space defined by the three-phase coils 40. The three-phase coils 40 may be fixedly and/or rigidly connected to the conduit 22 such that the three-phase coils 40 do not move relative to the conduit 22. FIG. 1 depicts seven of the three-phase coils 40, but the present invention may have any number of the three-phase coils 40.

The electromagnetic source such as, for example, the three-phase coils 40, may generate an electromagnetic field. The electromagnetic field may attract and, then, may repel the magnetically energized particles and/or the second fluid 25. The electromagnetic field may extend into the conduit 22. In an embodiment, the electromagnetic field may be applied to both one side of the conduit 22 and an opposite side of the conduit 22. In an embodiment, the electromagnetic field may extend from one side of the conduit to an opposite side of the conduit 22. In an embodiment, substantially all of the electromagnetic field may extend into the conduit 22. The section of the conduit 22 substantially surrounded by the electromagnetic source, such as, for example, the three-phase coils 40, may be manufactured from an electrical insulator, such as, for example: ceramic, glass, titanium, and/or a high-resistance and/or non-magnetic material, to avoid and/or limit interference of the conduit 22 with the electromagnetic field.

The electromagnetic source may use the electromagnetic field to move the second fluid 25 and/or the magnetically energized particles in a direction corresponding to the magnetic field. Moving the second fluid 25 and/or the magnetically energized particles may direct the first fluid 24 through the conduit 22. For example, repetitive and/or sequential attraction and repulsion of the electromagnetic particles and/or the second fluid 25 may force the first fluid 24 through the conduit 22. In an embodiment, moving the second fluid 25 and/or the magnetically energized particles may direct the first fluid 24 from the heat absorbing plate 26 through the conduit 22 to the heat spreader 30. In an embodiment, the movement of the electromagnetically charged particles and/or the second fluid 25 may force a first portion of the first fluid 24 from the heat absorbing plate 26 to the heat spreader 30 substantially simultaneously to forcing a second portion of the first fluid 24 from the heat spreader 30 to the heat absorbing plate 26. Current may be applied to the electromagnetic source to generate the electromagnetic field.

The system 10 may have one or more additional electromagnetic sources. The electromagnetic source and the additional electromagnetic sources may be activated in sequence to generate the electromagnetic field. For example, a first electromagnetic source may be activated. Then, the first electromagnetic source may be deactivated and/or a second electromagnetic source may be activated. Then, the first electromagnetic source and/or the second electromagnetic source may be deactivated and/or a third electromagnetic source may be activated. Then, the process may be repeated to continue generation of the electromagnetic field.

Accordingly, the electromagnetic source and the additional electromagnetic sources may be activated in sequence to move the electromagnetically charged particles and/or the second fluid 25 from one of the electromagnetic sources to a subsequent electromagnetic source. Movement of the electromagnetically charged particles and/or the second fluid 25 from one of the electromagnetic sources to a subsequent electromagnetic source may direct the first fluid 24 through the conduit 22. For example, the movement of the electromagnetically charged particles and/or the second fluid 25 from one of the electromagnetic sources to a subsequent electromagnetic source may force and/or may push the first fluid 24 through the conduit 22. In an embodiment, the electromagnetic source and the additional electromagnetic sources may use the electromagnetic field to direct the first fluid 24 through the conduit 22 without assistance from moving parts and/or mechanical means, such as, for example, a mechanical pump, a mechanical rotor or the like.

In an embodiment where the electromagnetic source is the one or more three phase coils 40, each of the three-phase coils 40 may have a first coil 41, a second coil 42 and/or a third coil 43 (collectively hereafter "the coils 41-43"). The coils 41-43 of each of the three-phase coils 40 may be activated in sequence to generate the electromagnetic field. For example, the first coil 41 of each of the three-phase coils 40 may be activated. Then, the first coil 41 of each of the three-phase coils 40 may be deactivated and/or the second coil 42 of each of the three-phase coils 40 may be activated. Then, the first coil 41 and/or the second coil 42 of each of the three-phase coils 40 may be deactivated and/or the third coil 43 of each of the three-phase coils 40 may be activated. Then, the process may be repeated.

Accordingly, the coils 41-43 of each of the three-phase coils 40 may be activated in sequence to move the electromagnetically charged particles and/or the second fluid 25 from the first coil 41 to the second coil 42 and, then, to the third coil 43 of each of the three-phase coils 40. Movement of the electromagnetically charged particles and/or the second fluid 25 from the first coil 41 to the second coil 42 and, then, to the third coil 43 of each of the three-phase coils 40 may direct the first fluid 24 through the conduit 22. For example, the movement of the electromagnetically charged particles and/or the second fluid 25 from the first coil 41 to the second coil 42 and, then, to the third coil 43 of each of the three-phase coils 40 may force and/or may push the first fluid 24 through the conduit 22. In an embodiment, the three-phase coils 40 may use the electromagnetic field to direct the first fluid 24 through the conduit 22 without assistance from moving parts and/or mechanical means, such as, for example, a mechanical pump, a mechanical rotor or the like.

Figure 2:
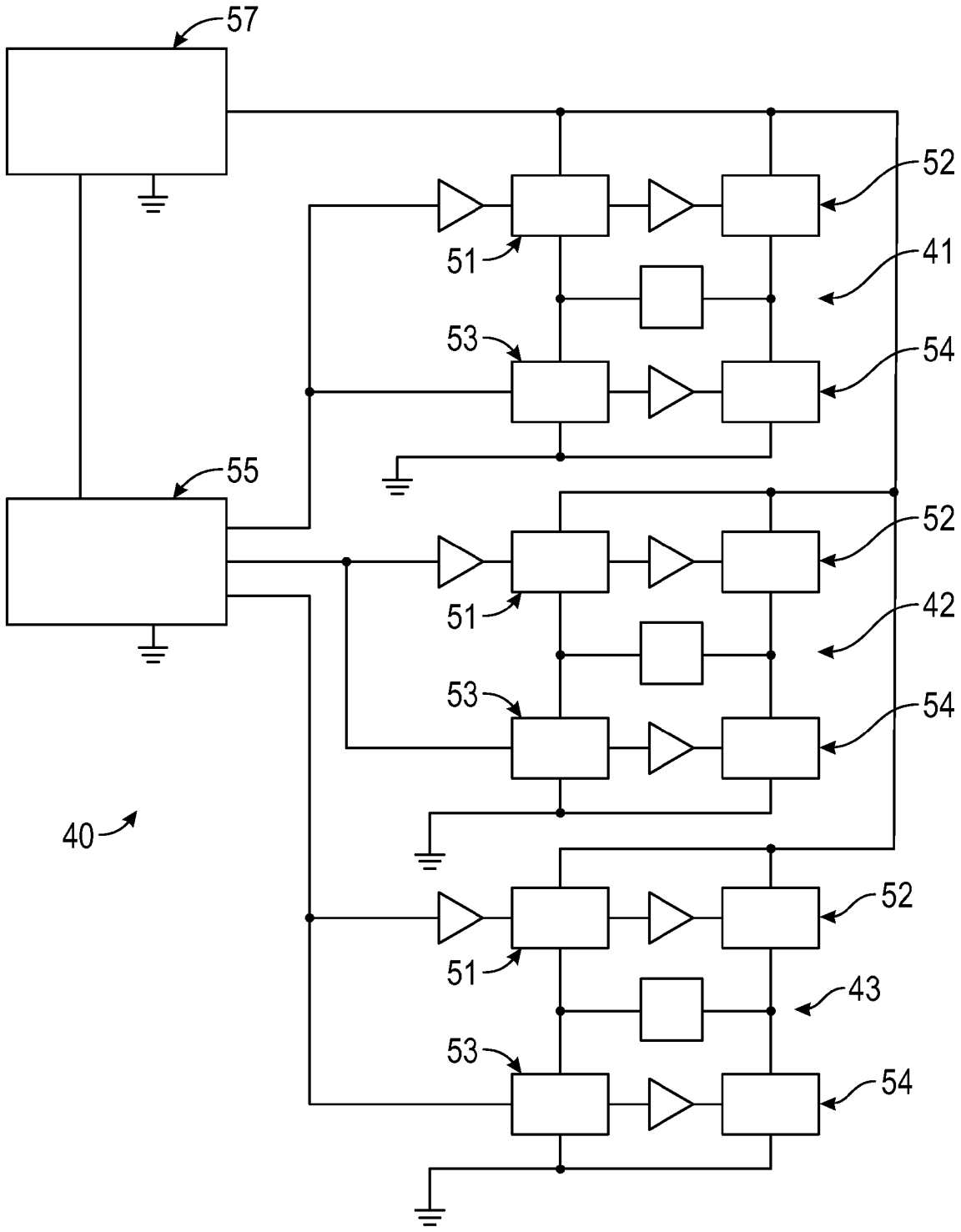
FIG. 2 illustrates a three-phase coil circuit in an embodiment of the present invention.

FIG. 2 generally illustrates one of the three-phase coils 40 in an embodiment of the present invention. As discussed previously, the three-phase coil 40 may have the first coil 41, the second coil 42 and/or the third coil 43. As shown in FIG. 2 and described hereafter, each of the coils 41-43 may be electrically controlled or powered by an H-bridge switch. For example, each of the coils 41-43 may have a first switching element 51, a second switching element 52, a third switching element 53 and/or a fourth switching element 54 (collectively hereafter "the switching elements 51-54"). Each of the switching elements 51-54 may be, for example, an insulated gate bipolar transistor ("IGBT"), a metal oxide semiconductor field effect transistor ("MOSFET") and/or the like. The present invention is not limited to a specific embodiment of the switching elements 51-54, and the switching elements 51-54 may be any electric switches known to one having ordinary skill in the art.

The current may be applied to the coils 41-43 by a power source 55, such as, for example, a surface power source electrically connected to the coils 41-43, a downhole mud turbine generator, a battery, a fuel cell, and/or the like. The current may be applied to each of the coils 41-43. The current may travel from the first coil 41 to the second coil 42, and/or the current may travel from the second coil 42 to the third coil 43. The current traveling through the coils 41-43 of the three-phase coil 40 may activate the coils 41-43 in sequence as described previously to generate the electromagnetic field. The present invention is not limited to a specific embodiment of the power source 55, and the power source 55 may be any power source known to one having ordinary skill in the art.

A microprocessor 57 may be electrically connected to the coils 41-43 and/or the power source 55. The microprocessor 57 may control the switching elements 51-54 of the coils 41-43 and/or regulate the current applied to the coils 41-43 of the three-phase coils 40 by the power source 55. For example, the microprocessor 57 may be programmed to act as a thermostat that may monitor a temperature of the heat source 20 and/or a temperature of the heat sink 32. The temperature of the heat source 20 and/or the temperature of the heat sink 32 may be provided by sensors (not shown) which may be in communication with the microprocessor 57. The microprocessor 57 may respond to changes in the temperature of the heat source 20 and/or the temperature of the heat sink 32 by controlling the electromagnetic field generated by the three-phase coils 40. For example, the microprocessor 57 may control the electromagnetic field by adjusting an amount of the current applied to the coils 41-43 of the three-phase coils 40 and/or by activating and/or deactivating the switching elements 51-54. Controlling the electromagnetic field by adjusting the amount of current applied to the coils 41-43 of the three-phase coils 40 and/or activating and/or deactivating the switching elements 51-54 may control a flow rate of the first fluid 24 through the conduit 22.

Figure 3:
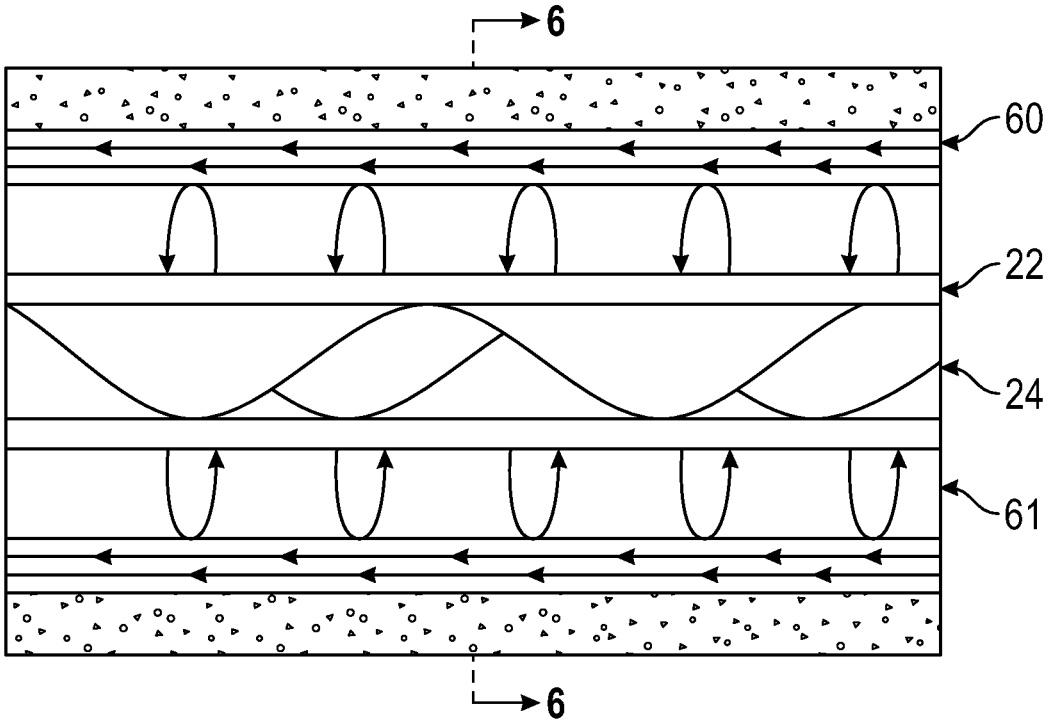
FIG. 3 illustrates a system for moving a first fluid using a second fluid in an embodiment of the present invention.
Figure 6:
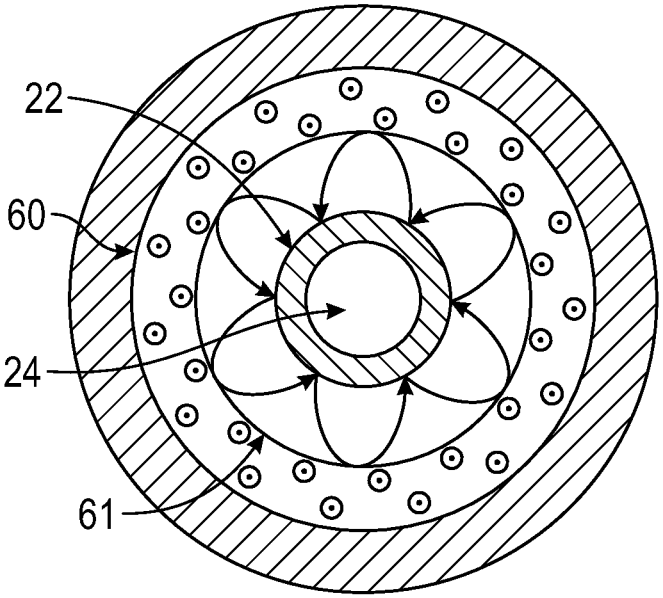
FIG. 6 is a cross-sectional view of the system of FIG. 3 for moving a first fluid using a second fluid in an embodiment of the present invention.

As shown in FIGS. 3 and 6, in an embodiment, the current traveling through the three-phase coils 40 may generate a linear electromagnetic field 60 and/or a rotating electromagnetic field 61. Combination of the linear magnetic field 60 and the rotating electromagnetic field 61 may result in the electromagnetically charged particles and/or the second fluid 25 to have a travel path of a rotating Archimedes screw and/or a similar shape. The travel path of the electromagnetic particles and/or the second fluid 25 may generate force which may direct the first fluid 24 through the conduit 22. The force may act as a virtual impeller in that electrical energy, namely the current applied to the coils 41-43 of each of the three-phase coils 40, may be converted into momentum in flow of the first fluid 24. In an embodiment, the electromagnetic source may rotate, spin or otherwise direct the second fluid 25 to propel the first fluid 24 without lateral movement of the second fluid 25 through the conduit 22, similar, fluid mechanically, to the principal of peristaltic pumping and fluid propulsion observed in biologic organisms. Advantageously, the electromagnetic source may direct the first fluid 24 without resistance typically associated with mechanical pumps.

In an embodiment, the three-phase coils 40 may generate the rotating electromagnetic field 61 using additional windings (not shown) of the three-phase coils 40. The additional windings may be positioned orthogonally relative to other coils of the three-phase coils 40, such as, for example, the coils 41-43. The current may travel through the additional windings of the three-phase coils 40 to generate the rotating electromagnetic field 61.

Figure 4:
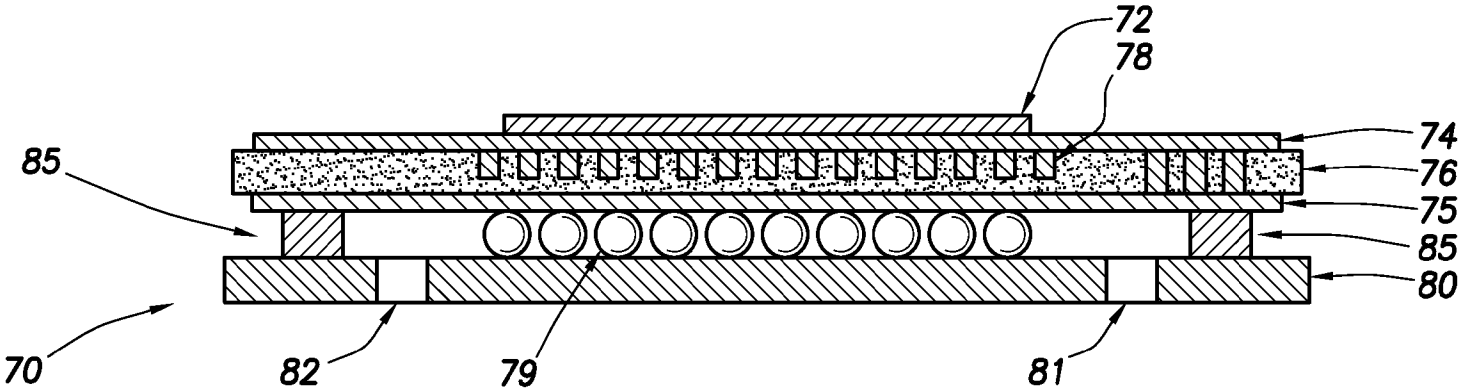
FIG. 4 illustrates a system for moving a first fluid using a second fluid in an embodiment of the present invention.

FIG. 4 generally illustrates a multi-chip module 70 in an embodiment of the present invention. The multi-chip module 70 may have a semiconductor circuit 72, such as, for example, a semiconductor motor driver circuit. The multi-chip module 70 may have one or more plates which may act as the heat absorbing plate 26. For example, the one or more plates may be direct-bonded copper, direct-bonded aluminum and/or the like which may be mechanically connected to the semiconductor circuit 72. In an embodiment, the multi-chip module 70 may have a first plate 74 and/or a second plate 75. The multi-chip module 70 may have a ceramic plate 76 which may be located between the first plate 74 and the second plate 75. In an embodiment, the semiconductor circuit 72 may be mechanically connected to the ceramic plate 76 by thermal studs 78. The thermal studs 78 may be imbedded in the ceramic plate 76, and/or the thermal studs 78 may assist heat conduction from the semiconductor circuit 72 through the ceramic plate 76.

The multi-chip module 70 may have a base 80. Walls 85 may mechanically connect the base 80 to the second plate 75. In an embodiment, the first plate 74, the second plate 75 and/or the walls 85 may be manufactured from copper. The base 80, the walls 85 and/or the second plate 75 may form a channel 85 through which the first fluid 24 may flow. The base 80 may have a first orifice 81 and/or a second orifice 82. The first fluid 24 may enter the channel 85 through the first orifice 81 and/or may exit the channel through the second orifice 82. The first plate 74, the thermal studs 78 and/or the second plate 75 may transfer heat from the semiconductor circuit 72 to the first fluid 24.

In an embodiment, shaped objects 79 may be located in the channel 85. In an embodiment, the shaped objects 79 may be spherical metallic balls, such as copper plated balls, that contact the second plate 75 and/or the base 80. In an embodiment, the shaped objects 79 may be mechanically connected to the second plate 75 and/or the base 80. The shaped objects 79 may provide mechanical stability and assist in thermal conductivity to the multi-chip module 70. The first fluid 24 may flow around the shaped objects 79 as the first fluid 24 travels through the channel 85. The present invention is not limited to a specific embodiment of the shaped objects 79.

Figure 5:
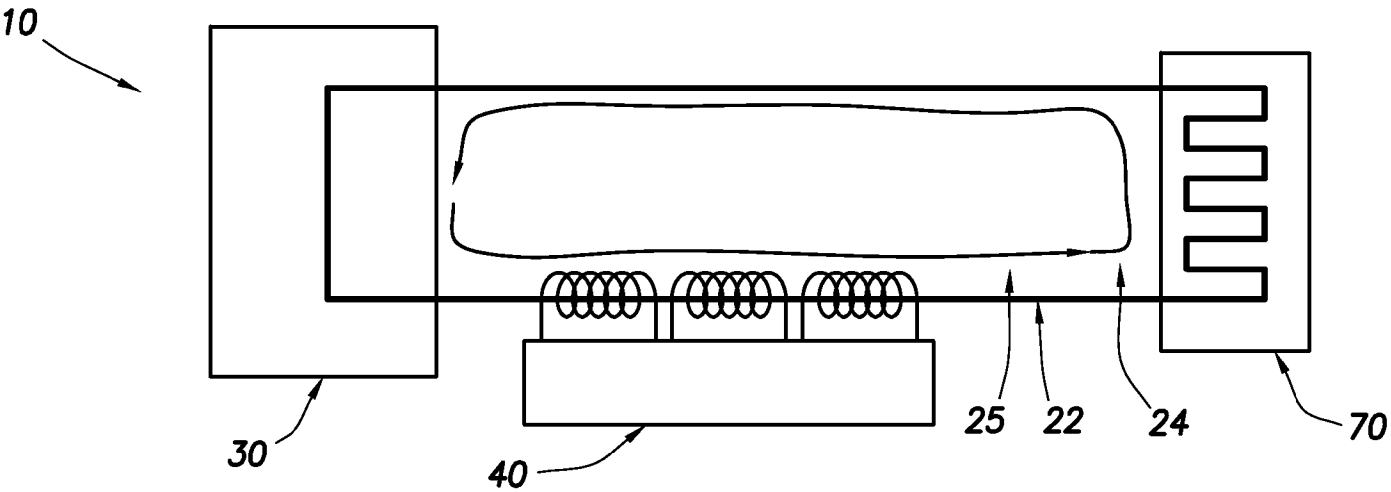
FIG. 5 illustrates a system for moving a first fluid using a second fluid in an embodiment of the present invention.

FIG. 5 generally illustrates use of the system 10 to maintain the temperature of the multi-chip module 70 in an embodiment of the present invention. The first fluid 24 may enter the channel 85 through the first orifice 81. For example, the electromagnetic field may direct the first fluid 24 into the first orifice 81 using the second fluid 25 and/or the magnetically charged particles. Then, the first fluid 24 may absorb the heat from the multi-chip module 70, and/or the first fluid 24 may exit the channel 85 using the second orifice 82. For example, the electromagnetic field may direct additional fluid into the first orifice 81 using the second fluid 25 and/or the magnetically charged particles, and/or the additional fluid may force the first fluid 24 to exit the channel 85 through the second orifice 82.

The electromagnetic field may direct the second fluid 25 and/or the magnetically charged particles with the first fluid 24 through the conduit 22 to the heat spreader 30. The heat spreader 30 may be in contact with the heat sink 32, such as, for example, the wellbore in which the multi-chip module 70 is located. The heat spreader 30 may transfer the heat from the first fluid 24 to the heat sink 32. For example, the temperature of the multi-chip module 70 may extend to approximately 270° C. to 300° C., and/or the borehole may have a temperature of approximately 200° C. The difference between the temperature of the multi-chip module 70 and the temperature of the borehole may enable the first fluid 24 to transfer the heat from the multi-chip module 70 to the borehole.

It should be understood that various changes and modifications to the presently preferred embodiments described herein will be apparent to those having ordinary skill in the art. Such changes and modifications may be made without departing from the spirit and scope of the present invention and without diminishing its attendant advantages. It is, therefore, intended that such changes and modifications be covered by the claims.

We claim:

1. A system for cooling a component of a downhole tool by moving a first fluid, the system comprising:

a conduit disposed within the downhole tool and containing the first fluid and a second fluid;

a heat absorbing plate connected to the conduit to transfer heat from a heat source of the downhole tool to the first fluid;

a heat spreader connected to the conduit to transfer heat from the first fluid to a heat sink; and an electromagnetic source substantially surrounding the conduit and generating a linear electromagnetic field and a rotating electromagnetic field both extending into the conduit.

2. The system of claim 1, wherein the linear electromagnetic field is configured to move the first fluid laterally through the conduit between the heat absorbing plate and the heat spreader using the second fluid, and wherein the rotating electromagnetic field is configured to move the second fluid in a spinning pattern within the conduit to propel the first fluid without lateral movement of the second fluid through the conduit.

3. The system of claim 1, wherein the linear electromagnetic field and the rotating electromagnetic field combine to produce a rotating screw path that propels the first fluid between the heat absorbing plate and the heat spreader.

4. The system of claim 1, wherein the second fluid comprises electromagnetic particles that move in response to the linear electromagnetic field and the rotating electromagnetic field to propel the first fluid through the conduit.

5. The system of claim 1, wherein the rotating electromagnetic field is configured to inhibit lateral movement of the second fluid through conduit.

6. The system of claim 1, wherein the second fluid is a ferrofluid attracted to the electromagnetic source.

7. The system of claim 1, wherein the electromagnetic source comprises three phase coils having a first set of windings disposed around the conduit to generate the linear electromagnetic field.

8. The system of claim 7, wherein the three phase coils have a second set of windings disposed orthogonal to the first set of windings to generate the rotating electromagnetic field.

9. The system of claim 7, wherein individual coils of the three phase coils are activated in sequence to generate the linear electromagnetic field and the rotating electromagnetic field.

10. The system of claim 1 wherein the heat sink comprises a third fluid disposed within a wellbore.

11. The system of claim 1, wherein the first fluid comprises a surfactant configured to inhibit adherence of particles of the second fluid to one another.

12. The system of claim 1, wherein the electromagnetic source is fixedly connected to the conduit.

13. The system of claim 1, wherein the electromagnetic source completely surrounds the conduit.

14. A system for cooling a component of a downhole tool by moving a first fluid, the system comprising:

a conduit forming a continuous closed loop disposed within the downhole tool and containing the first fluid and a second fluid in contact with the first fluid, the conduit having a section which has a first side and a second side located in a position opposite to the first side;

a heat absorbing plate connected to the conduit to transfer heat from a heat source disposed in the downhole tool to the first fluid;

a heat spreader connected to the conduit and disposed within the downhole tool to enable the heat spreader to transfer heat from the first fluid to a wellbore surrounding the downhole tool; and an electromagnetic source substantially surrounding the conduit, extending from the first side of the section of the conduit to the second side of the section of the conduit, and generating a linear electromagnetic field and a rotating electromagnetic field both extending into the conduit that combine to move the first fluid through the continuous closed loop between the heat absorbing plate and the heat spreader.

15. The system of claim 14, wherein the linear electromagnetic field is configured to move the first fluid laterally through the conduit between the heat absorbing plate and the heat spreader using the second fluid, and wherein the rotating electromagnetic field is configured to move the second fluid in a spinning pattern within the conduit to propel the first fluid without lateral movement of the second fluid through the conduit.

16. The system of claim 14, wherein the second fluid comprises a colloidal suspension of magnetically energized particles.

17. The system of claim 14, wherein the linear electromagnetic field and the rotating electromagnetic field combine to produce a virtual impeller.

18. The system of claim 14, wherein the electromagnetic source comprises three phase coils having windings disposed around the conduit to generate the linear electromagnetic field and the rotating electromagnetic field.

19. The system of claim 18, comprising a microprocessor configured to control the linear electromagnetic field and the rotating electromagnetic field by adjusting an amount of current applied to individual coils of the three phase coils.

20. The system of claim 18, wherein the microprocessor is configured to adjust current applied to the three phase coils to control a flow rate of the first fluid through the conduit.

* * * * *